United States Patent [19]

Scheidweiler et al.

[11] 4,364,031

[45] Dec. 14, 1982

[54] IONIZATION SMOKE DETECTOR WITH INCREASED OPERATIONAL RELIABILITY

[75] Inventors: Andreas Scheidweiler, Uerikon; Peter Müller, Oetwil am See, both of Switzerland

[73] Assignee: Cerberus AG, Männedorf, Switzerland

[21] Appl. No.: 198,807

[22] Filed: Oct. 20, 1980

[30] Foreign Application Priority Data

Dec. 14, 1979 [CH] Switzerland ..... 11077/79

[51] Int. Cl.[3] ..... G08B 17/10

[52] U.S. Cl. ..... 340/629; 250/381

[58] Field of Search ..... 340/629; 250/381, 382, 250/384, 385, 389, 388, 393

[56] References Cited

U.S. PATENT DOCUMENTS

| | | | |
|---|---|---|---|
| 3,295,121 | 12/1966 | Meyer | 340/629 |
| 3,500,368 | 3/1970 | Abe | 340/629 X |
| 3,521,263 | 7/1970 | Lampart et al. | 340/629 |
| 3,657,713 | 4/1972 | Sasaki et al. | 340/629 X |
| 3,714,641 | 1/1973 | Scheidweiler | 340/629 X |
| 3,797,008 | 3/1974 | Yuasa | 340/629 X |
| 3,872,449 | 3/1975 | Scheidweiler | 340/629 |
| 4,017,852 | 4/1977 | Kabat | 340/629 |

FOREIGN PATENT DOCUMENTS

| | | | |
|---|---|---|---|
| 2299879 | 9/1976 | France . | |
| 831812 | 3/1960 | United Kingdom | 340/629 |

*Primary Examiner*—John W. Caldwell, Sr.
*Assistant Examiner*—Daniel Myer
*Attorney, Agent, or Firm*—Werner W. Kleeman

[57] ABSTRACT

An ionization smoke detector containing at least one ionization chamber operated at an extra low voltage or potential. The ionization chamber contains a sensor employing a measuring electrode and a counter electrode. Ambient air has practically free access to the ionization chamber and there are provided one or more radioactive sources for generating ions, a supply voltage source and an electrical circuit for triggering an alarm. The smoke detector possesses increased operational reliability since circuit elements are provided which enable signal reporting to a central station by means of a low-voltage of about 200 volts, however the sensor is operated at an extra low voltage.

6 Claims, 5 Drawing Figures

Fig. 1
(PRIOR ART)
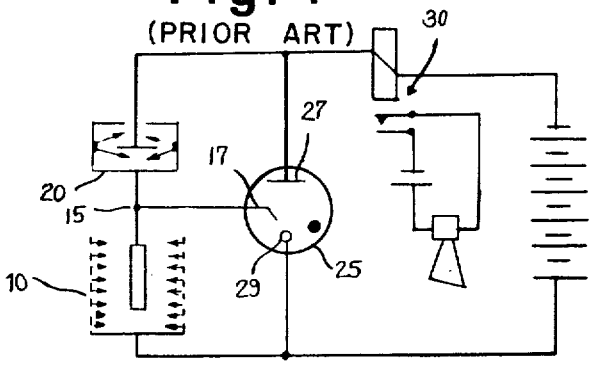
Fig. 2
(PRIOR ART)
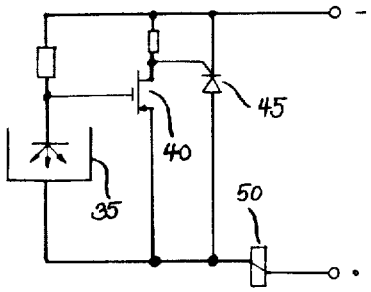
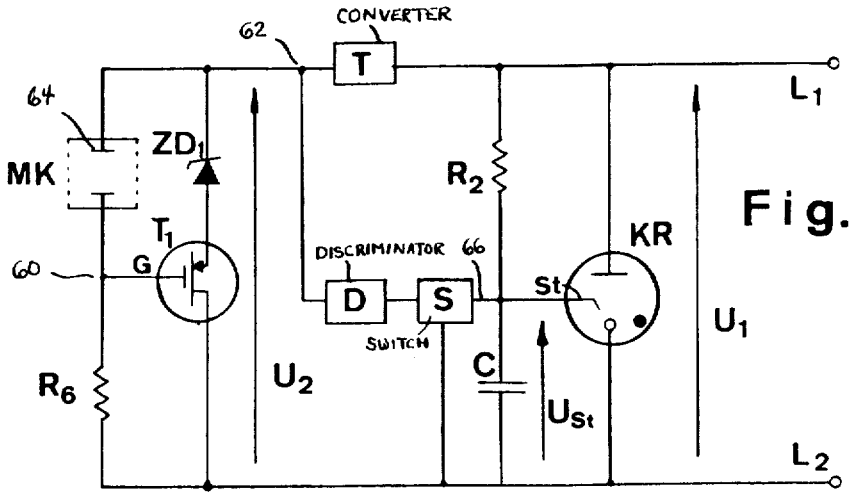
Fig. 3
Fig. 4
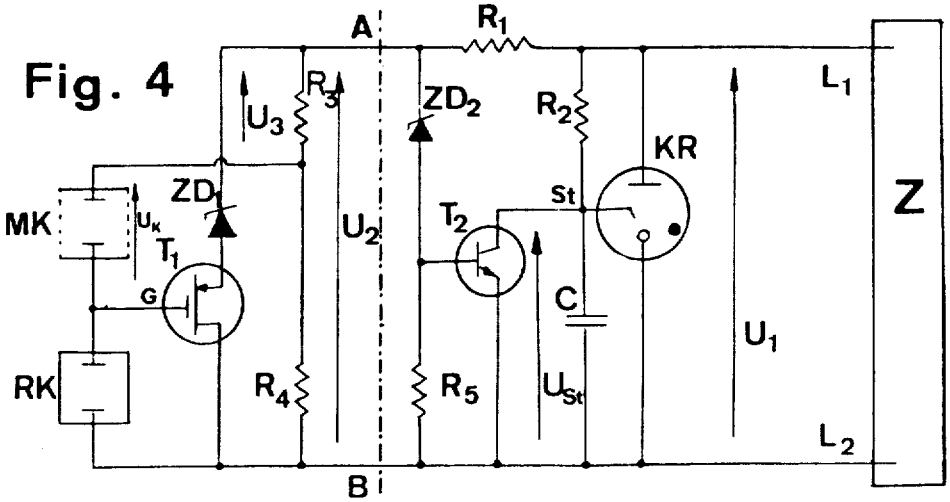

IONIZATION SMOKE DETECTOR WITH INCREASED OPERATIONAL RELIABILITY

BACKGROUND OF THE INVENTION

The present invention relates to a new and improved construction of an ionization smoke detector.

Generally speaking, the ionization smoke detector of the present invention is of the type containing at least one ionization chamber operating at an extra low voltage, the ionization chamber containing a sensor having a measuring electrode and a counter electrode. The ambient air has practically free access to the ionization chamber and the latter is provided with at least one radioactive source for generating ions. An electrical circuit is provided for alarm triggering, and the smoke detector is connected by means of lines with a central signal station which delivers a detector-operating voltage to the lines.

As to the presently employed fire alarms known in this technology ionization smoke detectors are the ones most widely employed as early warning detectors. Certain of the primary advantages of such type smoke detectors are their universal applicability and their simple and robust mechanical construction. Since the fire alarm, in the event there is encountered a combustion process, must respond rapidly and positively, but on the other hand should not be triggered by any false alarms, high requirements are placed upon the operational reliability of such ionization smoke detectors. Examples of ionization fire alarms are those disclosed, for instance, in U.S. Pat. Nos. 3,714,641, 3,909,813 and 4,037,106.

The principle of operation of heretofore known ionization smoke detectors is predicated upon markedly reducing the ionic current flowing between both electrodes of the measuring chamber whenever smoke penetrates into such measuring chamber. At the present time there are predominantly employed two types of ionization smoke detectors:

1. The low-voltage smoke detectors which operate at an operating voltage of about 200 volts, for instance as exemplified by the apparatus disclosed in U.S. Pat. No. 3,233,100 serving to detect aerosols in gases; and 2. The extra low-voltage smoke detectors which operate with an operating voltage of less than 50 volts, for instance, the ionization fire alarm installation as described in U.S. Pat. No. 3,521,263.

The low-voltage smoke detectors use as the electrical amplifier element a cold-cathode tube. But however they have an appreciably greater signal-to-noise ratio than the extra low-voltage smoke detectors. In FIG. 1 there has been shown the circuitry of a typical low-voltage smoke detector wherein the measuring ionization chamber 10 is operated in series with a work resistor 20, preferably in the form of a saturated reference chamber. The connection point 15 or junction of both chambers 10 and 20 is connected with a control electrode 17 of a cold-cathode tube 25. The voltage drop across the measuring chamber 10, in the quiescent or rest condition, amounts to about 80 volts. When smoke penetrates into the measuring chamber 10 this voltage or potential increases by about 50 volts, and thus, reaches the ignition or firing voltage of the cold-cathode tube 25. This in turn causes a current flow to take place between the anode 27 and cathode 29, which can be suitably evaluated by means of a relay 30 for alarm triggering purposes.

Operational disturbances in ionization smoke detectors arise, on the one hand, because the detectors trip false alarms, or, on the other hand, the sensitivity of the detectors decreases during their operating time, which in an extreme case can result in a complete breakdown of the fire alarm. The low-voltage fire alarms of the previously described type are relatively insensitive to electrical disturbances which are captured by the line network acting as an antenna, since these disturbances or spurious signals must have an appreciable magnitude, i.e. must at least amount to 50 volts, in order to ignite the cold-cathode tube. Therefore, with such type detectors false alarms caused by electromagnetic disturbances are relatively seldom.

The chamber voltage of approximately 100 volts, needed for operating the low-voltage ionization smoke detectors, however, causes high electrical field intensities of several 100 V/cm to appear at the measuring electrode. The dust particles which are always present in air tend to electrostatically deposit at the electrodes. This in turn causes the electrodes to become coated with a dust layer which gradually becomes thicker. If such dust particles consist of electrically non-conductive materials, something which particularly frequently is the case in dry winter periods, then the ionic current within the measuring chamber is blocked and there can arise triggering of a false alarm. This makes it necessary that the fire alarm frequently be cleaned. But such work is associated with high costs.

With the availability of field-effect transistors it was possible to develop ionization smoke detectors which could be operated with an operating voltage of less than 50 volts. One such construction of ionization smoke detector of the extremely or extra low-voltage type has been described, for instance, in the aforementioned U.S. Pat. No. 3,521,263. In FIG. 2 of the accompanying drawings there has been illustrated circuitry of a typical extra low-voltage ionization smoke detector. The voltage appearing across the measuring chamber 35 simultaneously constitutes the gate voltage or potential for the field-effect transistor 40. This potential is chosen such that the transistor 40 is without current in its quiescent state. The controlled rectifier (SCR) therefore likewise, generally indicated by reference character 45, is blocked and the relay 50 is not energized. If the smoke or other combustion products enter into the measuring chamber 35 then the chamber voltage increases and upon exceeding a certain threshold value causes the firing of the SCR, so that the relay 50 triggers an alarm.

With such extra low-voltage ionization smoke detectors the change in potential at the measuring ionization chamber, needed for triggering an alarm, only amounts to a few volts. Since in the line network there can arise spurious pulses or signals of this order of magnitude, with this type of fire alarm there always exists the danger of false alarms. To compensate for this drawback there is needed an appreciable electronic circuit expenditure. On the other hand, as a compensating factor for this disadvantage is the positive benefit that with such type of fire alarms the danger of contamination is appreciably smaller owing to the considerably reduced field intensity.

Exceedingly high security requirements are placed upon fire alarm installations for obvious reasons. Up to the present it was not possible, in the case of ionization smoke detectors of the low-voltage type, to overcome the dust contamination danger, or in the case of the extremely or extra low-voltage fire alarms to elimate with simple means the susceptibility to electrical disturbances.

SUMMARY OF THE INVENTION

Therefore, with the foregoing in mind it is a primary object of the present invention to provide a new and improved construction of ionization smoke detector having increased operational reliability.

Another and more specific object of the present invention aims at eliminating the previously described disadvantages of the heretofore known ionization smoke detectors, and, in particular, to construct an ionization smoke detector having increased operational reliability, which reduces the contamination tendency of the smoke detector by virtue of a reduced field intensity within the ionization chamber, so that the maintenance or service intervals can be prolonged, wherein in relation to high-voltage fire alarms or detectors there is required a lesser quantity of radioactive material, and wherein the detector is relatively insensitive to electromagnetic disturbances.

Now in order to implement these and still further objects of the invention, which will become more readily apparent as the description proceeds, the smoke detector of the present development is manifested by the features that it contains a converter which reduces the detector operating potential to the sensor operating potential in such a manner that such is at least five times smaller than the detector operating potential or voltage. Additionally, there is provided a first circuit element which is at the sensor operating potential and which is controlled by the voltage drop appearing across the ionization chamber. The first circuit element becomes conductive upon exceeding a certain smoke density and reduces the sensor operating voltage. There is further provided a second circuit element which is at the potential of the detector operating voltage and which is controlled by the sensor operating voltage or potential. This second circuit element becomes conductive when the sensor operating voltage falls below a predetermined value and triggers an alarm signal.

According to a preferred constructional embodiment of the inventive ionization smoke detector the converter is designed such that the sensor operating voltage is at least ten times smaller than the detector operating voltage. The first circuit element possesses a field-effect transistor which is blocked or non-conductive in its quiescent or rest state, the gate electrode of the field-effect transistor being connected with the measuring electrode of the ionization chamber, so that upon exceeding a certain smoke density the field-effect transistor becomes conductive. Additionally, the second circuit element contains a cold-cathode tube serving as a bistable switching element, whose control voltage is maintained by a switch in the rest or quiescent condition below the firing or ignition potential of the control electrode of the cold-cathode tube. The ionization smoke detector of the preferred embodiment additionally contains means which actuate the switch, upon opening of the field-effect transistor, in such a manner that the control voltage of the cold-cathode tube slowly ascends until there is reached the firing potential and the cold-cathode tube is ignited.

According to a further preferred embodiment of the inventive ionization smoke detector the switch comprises a transistor, which in its quiescent state is conductive and saturated. Between the collector and emitter of such transistor there is connected a capacitor, and between the collector of the transistor and the anode of the cold-cathode tube there is connected a resistance, wherein the time-constant of the RC-element amounts to $R \times C >$ two seconds, preferably five seconds.

According to a further preferred embodiment the converter comprises a resistor, a Zener diode and the base-emitter path of the transistor.

BRIEF DESCRIPTION OF THE DRAWINGS

The invention will be better understood and objects other than those set forth above will become apparent when consideration is given to the following description. Such description makes reference to the following drawings wherein:

FIG. 1 illustrates circuitry of a known low-voltage ionization smoke detector;

FIG. 2 illustrates circuitry of a known extra low-voltage ionization smoke detector;

FIG. 3 illustrates circuitry of an ionization smoke detector having an increased operational realiability and constructed according to the present invention;

FIG. 4 illustrates circuitry of a preferred exemplary embodiment of inventive ionization smoke detector.

DETAILED DESCRIPTION OF THE PREFERRED EMBODIMENTS

Figure 5:
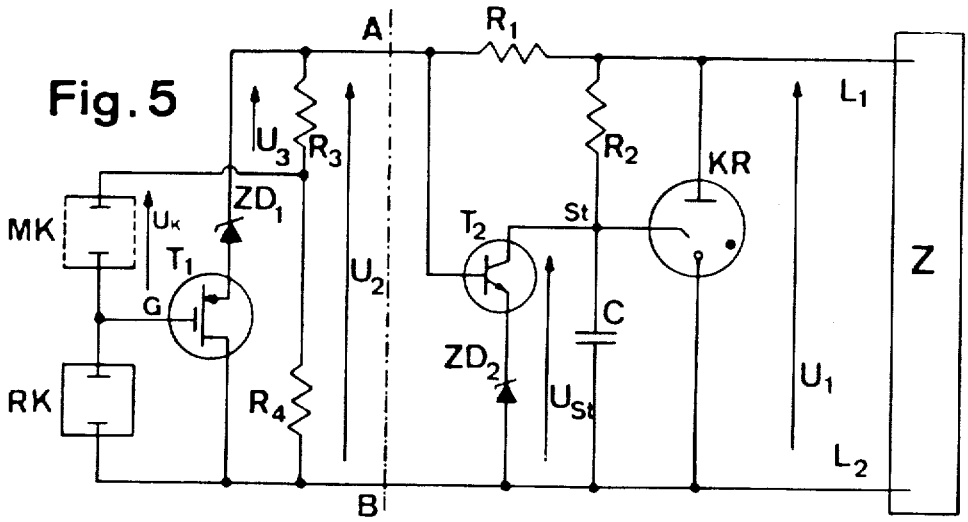
FIG. 5 illustrates circuitry, like the arrangement of FIG. 4, but of a modified construction of ionization smoke detector.

For purposes of better comprehending the teachings of the invention there has been made reference to the prior art ionization smoke detectors of FIGS. 1 and 2 which were discussed at the beginning of this disclosure. Turning attention now to FIG. 3, there is illustrated therein an embodiment of an ionization smoke detector constructed according to the invention. A measuring ionization chamber or compartment MK, which is accessible to the external atmosphere or ambient air, is connected in series with a work resistance or resistor $R_6$. The connection point or terminal 60 of the measuring ionization chamber MK and the work resistance $R_6$ is connected with the gate electrode G of a field-effect transistor $T_1$. The drain-source path of the field-effect transistor $T_1$ is connected by means of a Zener diode $ZD_1$ parallel to the measuring chamber-work resistance path.

The detector operating voltage or potential $U_1$ amounting to for instance about 200 volts, which is applied from the signal station or central station Z by means of the lines $L_1$ and $L_2$ to the detector, is infed by means of a converter T. The converter T reduces the detector operating voltage or potential $U_1$ to the sensor operating voltage $U_2$. The low-voltage output 62 of the converter T is connected both with the one electrode 64 of the measuring chamber MK as well as also with a discriminator D serving to control a switch S. This switch S acts upon a control electrode St of a cold-cathode tube KR which is connected in circuit between the lines or conductors $L_1$ and $L_2$. This control electrode St of the cold-cathode tube KR, apart from being connected with the output side 66 of the switch S, is connected by means of the resistance or resistor $R_2$ with the line $L_1$ and by means of a capacitor C with the line $L_2$.

When smoke penetrates into the measuring chamber MK the conductivity of such measuring chamber is reduced, the potential $U_K$ across the measuring chamber MK increases and the transistor $T_1$ becomes conductive. Thus, the sensor operating voltage $U_2$ is reduced. The discriminator D is designed such that upon falling below a certain threshold value of the sensor operating voltage $U_2$ the switch S, whose output in the rest state maintains the control electrode voltage $U_{st}$ of the cold-cathode tube KR below the firing or ignition voltage (preferably more than 50 volts below), is actuated such that the capacitor C can charge through the resistor $R_2$ until there has been reached the firing or ignition potential and the cold-cathode tube KR is ignited. The current increase which arises at the conductors or lines $L_1$ and $L_2$ can be evaluated in conventional manner at the central signal station Z as an alarm signal for triggering an alarm.

FIG. 4 illustrates in detail a preferred embodiment of circuitry of inventive ionization smoke detector. In this case the work resistance $R_6$ of FIG. 3 which is connected in series with the measuring chamber MK is designed as a reference ionization chamber RK which is not readily accessible to the ambient atmosphere and operates in the saturation region. The detector operating voltage $U_1$ is delivered to a voltage stabilizer circuit composed of a resistor $R_1$, a Zener diode $ZD_2$ and the base-emitter path of a transistor $T_2$. The voltage stabilizer circuit delivers the sensor operating voltage $U_2$ needed for the operation of the extra low-voltage sensor. In the normal case, i.e., when no smoke has penetrated into the measuring chamber MK, the current which flows through the Zener diode $ZD_2$ simultaneously also flows through the base-emitter path of the transistor $T_2$, so that this transistor $T_2$ becomes conductive and short-circuits the capacitor C. The control voltage $U_{st}$, which appears at the control electrode St of the cold-cathode tube KR, amounts to practically zero. A voltage divider $R_3$, $R_4$, arranged parallel to the points A and B, produces a bias $U_3$ such that the field-effect transistor $T_1$ is blocked in its rest state.

If the voltage $U_K$, which decreases across the measuring chamber MK, exceeds a threshold value determined by the voltage divider $R_3$, $R_4$, then the field-effect transistor $T_1$ is rendered conductive and an additional current flows through the resistor $R_1$. Hence, the sensor operating voltage $U_2$ is reduced below the Zener voltage of the Zener diode $ZD_2$, so that the base current of the transistor $T_2$ is interrupted, and this transistor $T_2$ is blocked. Now the capacitor C charges across the resistor $R_2$. If the voltage $U_{st}$ across the capacitor C reaches the firing potential of the cold-cathode tube KR, then this cold-cathode tube is ignited and an intensive current flows through the lines $L_1$ and $L_2$. This current flow can be evaluated for triggering an alarm at the central signal station Z.

The time-constant of the RC-element $R_2$, C is chosen such that after blocking of the transistor $T_2$ the firing or ignition voltage of the control electrode St first is reached after several seconds, e.g. after about ten seconds. Briefly lasting electrical disturbances, leading to the field-effect transistor $T_1$ opening or becoming conductive, do not cause any alarm triggering, since the firing potential of the cold-cathode tube KR has not been reached. While the charging of the capacitor C through the resistor $R_2$ occurs slowly, upon closing of the field-effect transistor $T_1$ there is undertaken an instantaneous discharging of the capacitor C, since such is short-circuited by means of the transistor $T_2$. If brief surges of smoke repetitively occur, as such for instance can happen when individuals in the monitored room or area intensively smoke tobacco products or the like, it is not thus possible for a false alarm to be triggered, since due to the immediate discharge of the capacitor C there cannot arise any accumulation of the charges.

As shown in FIG. 5, a further preferred embodiment can be obtained by exchanging the elements of the voltage stabilizer circuit in that the Zener diode $ZD_2$ is arranged between the emitter of the transistor $T_2$ and the line $L_2$ and the base of the transistor $T_2$ is directly connected with the point A. With this modification there can be omitted the resistor $R_5$. The quiescent potential at the control electrode St of the cold-cathode tube KR approximately corresponds to the Zener voltage and for the firing of the cold-cathode tube there is required a collector-emitter voltage at the transistor $T_2$ which is lower by the same amount.

While there are shown and described present preferred embodiments of the invention, it is to be distinctly understood that the invention is not limited thereto, but may be otherwise variously embodied and practiced within the scope of the following claims. Accordingly,

What we claim is:

1. In an ionization smoke detector containing an ionization chamber operated at an extra low voltage, said ionization chamber having a sensor composed of a measuring electrode and a counter electrode, the ambient air being accessible to the ionization chamber, the ionization chamber containing at least one radioactive source for generating ions, an electrical circuit for triggering an alarm, the smoke detector being connected by means of lines with a central signal station which delivers to the lines a detector operating voltage, the improvement which comprises:

converter means provided for said smoke detector;

said converter means reducing the detector operating voltage to the operating voltage of the sensor such that such sensor operating voltage is at least five times smaller than the detector operating voltage;

a first circuit element which is at the sensor operating voltage and controlled by a voltage drop appearing across the ionization chamber;

said first circuit element upon exceeding a predetermined smoke density becoming conductive and reducing the sensor operating voltage;

a second circuit element which is at the detector operating voltage and controlled by the sensor operating voltage; and said second circuit element, when the sensor operating voltage falls below a predetermined value becoming conductive and triggering an alarm signal.

2. In an ionization smoke detector containing an ionization chamber operated at an extra low voltage, said ionization chamber having a sensor composed of a measuring electrode and a counter electrode, the ambient air being accessible to the ionization chamber, the ionization chamber containing at lease one radioactive source for generating ions, an electrical circuit for triggering an alarm, the smoke detector being connected by means of lines with a central signal station which delivers to the lines a detector operating voltage, the improvement which comprises:

converter means provided for said smoke detector;

said converter means reducing the detector operating voltage to the operating voltage of the sensor such that such sensor operating voltage is at least five times smaller than the detector operating voltage;

a first circuit element which is at the sensor operating voltage and controlled by a voltage drop appearing across the ionization chamber;

said first circuit element upon exceeding a predetermined smoke density becoming conductive and reducing the sensor operating voltage;

a second circuit element which is at the detector operating voltage and controlled by the sensor operating voltage; and said second circuit element, when the sensor operating voltage falls below a predetermined value, becoming conductive and triggering an alarm signal;

said converter means reducing the detector operating voltage to the sensor operating voltage such that the sensor operating voltage is at least ten times smaller than the detector operating voltage;

said first circuit element comprising a field-effect transistor which is non-conductive in its rest state;

said field-effect transistor having a gate, source and drain;

said gate being connected with a measuring electrode of the ionization chamber so that upon exceeding a certain smoke density the field-effect transistor is rendered conductive;

said second circuit element comprising a cold-cathode tube having a control electrode and constituting a bistable switching element;

switch means cooperting with said cold-cathode tube;

said cold-cathode tube having a control voltage which is maintained by said switch means in the rest state below the firing voltage of the control electrode of the cold-chathode tube; and means for actuating said switch means upon becoming conductive of the field-effect transistor such that the control voltage of the cold-cathode tube slowly ascends until there is reached the firing voltage and the cold-cathode tube ignites.

3. The ionization smoke detector as defined in claim 2, wherein:

said switch means comprises a transistor which is conductive in its rest state and is saturated;

said transistor having a collector, base and emitter;

a capacitor connected in circuit between said collector and emitter of said transistor;

said cold-cathode tube having an anode;

a resistor connected between the collector of the transistor and the anode of the cold-cathode tube;

said resistor and said capacitor forming a RC-element whose time-constant is greater than two seconds.

4. The ionization smoke detector as defined in claim 3, wherein:

said converter means comprises a resistor, a Zener diode and the base-emitter path of the transistor.

5. The ionization smoke detector as defined in claim 4, wherein:

the resistor of the converter means is connected at one terminal thereof directly with the line carrying a positive potential;

said Zener diode being connected by means of the other terminal of said resistor of said converter means by means of the base-emitter path of the transistor with the other line carrying a negative potential; and a further resistor arranged parallel to the base-emitter path of said transistor.

6. The ionization smoke detector as defined in claim 4, wherein:

said resistor of said converter means is directly connected at one terminal thereof with the line carrying a positive potential;

the base of the transistor being connected with the other terminal of said resistor of said converter means; and said Zener diode being arranged in circuit between the emitter of said transistor and the other line which carries the negative potential.

* * * * *